US008562384B2

(12) United States Patent
Vallejo

(10) Patent No.: US 8,562,384 B2
(45) Date of Patent: Oct. 22, 2013

(54) ENTERTAINING NOSE CLASP APPARATUS

(76) Inventor: Carl J. Vallejo, Ronkonkoma, NY (US)

( * ) Notice: Subject to any disclaimer, the term of this patent is extended or adjusted under 35 U.S.C. 154(b) by 146 days.

(21) Appl. No.: 13/063,461

(22) PCT Filed: Sep. 10, 2009

(86) PCT No.: PCT/US2009/005107

§ 371 (c)(1),
(2), (4) Date: Mar. 10, 2011

(87) PCT Pub. No.: WO2010/030377

PCT Pub. Date: Mar. 18, 2010

(65) Prior Publication Data

US 2011/0171873 A1 Jul. 14, 2011

Related U.S. Application Data

(60) Provisional application No. 61/191,610, filed on Sep. 10, 2008, provisional application No. 61/152,677, filed on Feb. 14, 2009.

(51) Int. Cl.
*A63H 33/00* (2006.01)
*A41G 7/00* (2006.01)

(52) U.S. Cl.
USPC ..... 446/27; 2/206

(58) Field of Classification Search
USPC ..... 446/27, 416, 485; 2/206
See application file for complete search history.

(56) References Cited

U.S. PATENT DOCUMENTS

| | | | | | |
|---|---|---|---|---|---|
| 3,266,490 | A * | 8/1966 | Klinger et al. | ..... | 128/206.15 |
| 3,695,265 | A * | 10/1972 | Brevik | ..... | 128/206.14 |
| 5,357,947 | A * | 10/1994 | Adler | ..... | 128/201.13 |
| 5,533,504 | A * | 7/1996 | Stamos | ..... | 128/201.18 |
| D421,117 | S * | 2/2000 | Hunter | ..... | D24/110.1 |
| 6,302,103 | B1 * | 10/2001 | Resnick | ..... | 128/201.23 |
| 6,758,215 | B2 * | 7/2004 | Begum | ..... | 128/203.29 |
| 2007/0294802 | A1 * | 12/2007 | Lin | ..... | 2/206 |

* cited by examiner

*Primary Examiner* — Nini Legesse
(74) *Attorney, Agent, or Firm* — Harold G. Furlow, Esq.

(57) ABSTRACT

An entertaining nose clasp apparatus is described that includes a nose clasp, an extension and an entertainment device. The nose clasp includes two components and a mechanism for the adjustment of the components. The components connect to the nose of a wearer. The extension includes a first side an opposing second side and side edges. The extension is positionable adjoining the nose. The extension stabilizes the position of the entertainment device relative to the nose of the wearer. The entertaining nose clasp apparatus is constructed for operational use in odorous environments, but can also be used in other environments for entertainment. The entertainment device includes a broad range of decorative two and three dimensional objects.

7 Claims, 15 Drawing Sheets

FIG. 8A
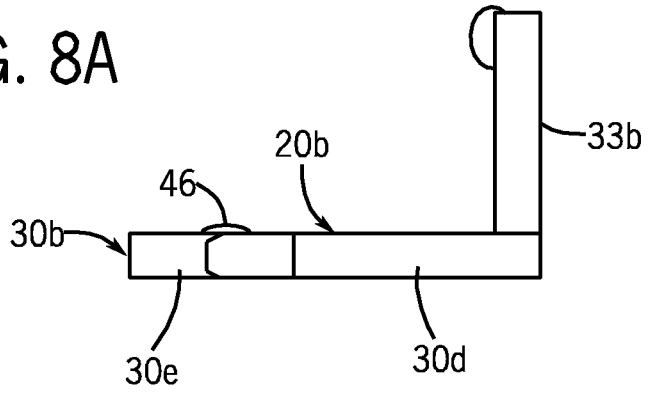
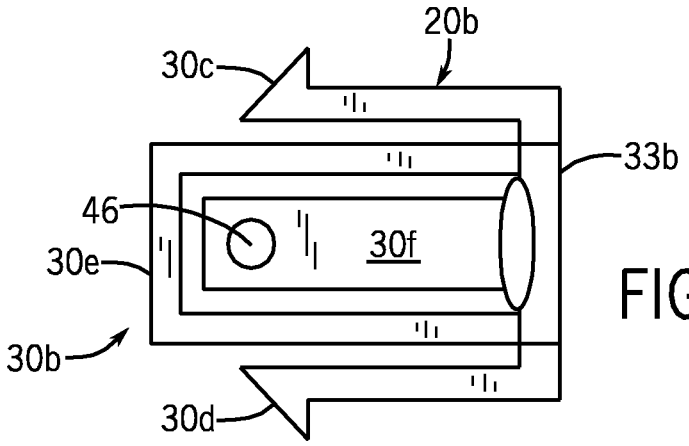
FIG. 8B
FIG. 8C
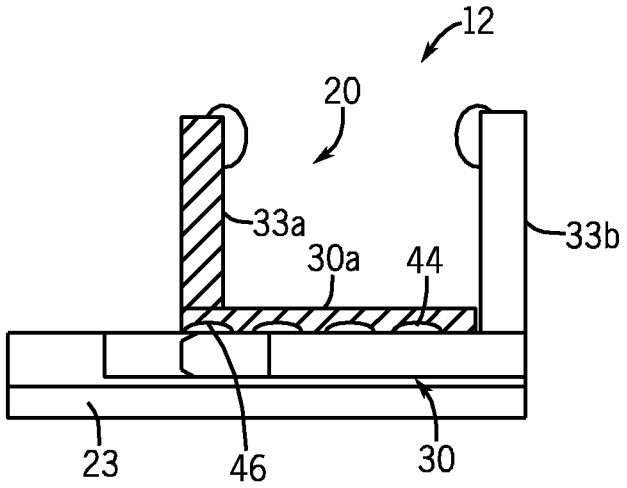

ENTERTAINING NOSE CLASP APPARATUS

CROSS-REFERENCE TO RELATED APPLICATIONS

This application claims priority to US PCT/2009005107 filed Sep. 10, 2009 that claimed priority to provisional applications 61/191,610 filed on Sep. 10, 2008 and 61/152,677 filed on Feb. 14, 2009, the disclosures of which are incorporated by reference herein and made a part of this application.

BACKGROUND OF THE INVENTION

1. Field of the Invention

The present disclosure relates to entertainment devices connected to a wearer and in particular to entertainment devices that connect to a nose of a wearer.

2. Description of the Related Art

Entertainment devices such as masks are commonly connected to the head of a wearer as a hood or by a band that extends behind the head. These devices provide a pure entertainment function that is a source of recreation for many. Devices that attach directly to the nose include false noses and false facial hair such as mustaches. There are also a number of devices that attach to a wearer's nose that provide functions such as closing the nostril opening while swimming, during artificial respiration, inhibiting nasal respiration associated with respiratory protective devices or to control breathing during sleep.

Dirty diapers have the well-known disadvantage that they often have unpleasant odors. Many times the odor is so unpleasant that it is uncomfortable to the person changing the diaper. Changing diapers also have the risk that infant is usually active and constantly reaching and squirming during the changing process. There is a strong need for infants to be entertained in order to minimize any undesirable movements that can lead to the infant interfering with the diaper changing process and in particular the undesirable spreading of the waste from the diaper. Heretofore there has never been an apparatus that provides a nose clasp with an entertainment device for entertaining.

SUMMARY OF THE INVENTION

An entertaining nose clasp apparatus is described that comprises a plate, a nose clasp and an entertainment device. The plate has a first side, a second opposed side and side edges. The nose clasp includes a band and an extension. The band has two adjustable components adapted to connect to the outside of a nose of a wearer in proximity to the nostrils. The extension has a first side, a second opposed side and side edges. The extension connects to the band and the extension is structured for positioning on the face of the wearer adjoining the nose. Adjoining the nose as defined herein means on or in proximity to the nose.

The nose clasp includes an adjustment mechanism or mechanism for the adjusting and attaching of the components to the nostrils and/or bridge of the nose of the wearer. The adjustment mechanism accommodates the repositioning of the components of the nose clasp through the resilience of the components and by the mechanical repositioning of at least one of the components relative to the other component. The nose clasp is connected to the plate. The extension is a planar or plate type structure that can be positioned in fixed spaced separation from the band, movably positionable on the plate as well as movably adjustable relative to the plate. The extension connects to the plate on one side edge and has an opposing free edge that is positionable between the upper lip and nose of the wearer. The entertainment device is connected to the plate and is an object primarily for the entertaining of children, but it can also be used for adult entertainment. The extension stabilizes the position of the entertainment device relative to the nose of the wearer. The nose clasp is constructed to be able to occlude the nostrils of the wearer or alternatively to allow for the passage of air through the nasal passages. The stabilizing providing by the extension can also include lateral stabilization of the entertainment device relative to the nose of the wearer. The extension connects to the plate on one end and has an opposing free edge that is positionable above an upper lip and below the nose of the wearer for the stabilizing of the entertainment device. The plate has a connector that receives electronics and the entertainment device couples to the electronics. The mechanism of the nose clasp can include a first components being fixed relative to the plate and a second component adjustable relative to the first component. The mechanism of the nose clasp can also include two components being repositionable relative to the plate and each other. The components can be resilient cantilever beams.

BRIEF DESCRIPTION OF THE DRAWINGS

FIG. 8A is bottom view of a first component of a third adjustment mechanism of the entertaining nose clasp apparatus of FIG. 1;

FIG. 8B is a rear view of the first component of the third adjustment mechanism of FIG. 8A;

FIG. 8C is a bottom view of the adjustment mechanism of FIG. 8C showing the interface between the first component and the second component;

DETAILED DESCRIPTION OF THE INVENTION

Figure 1:
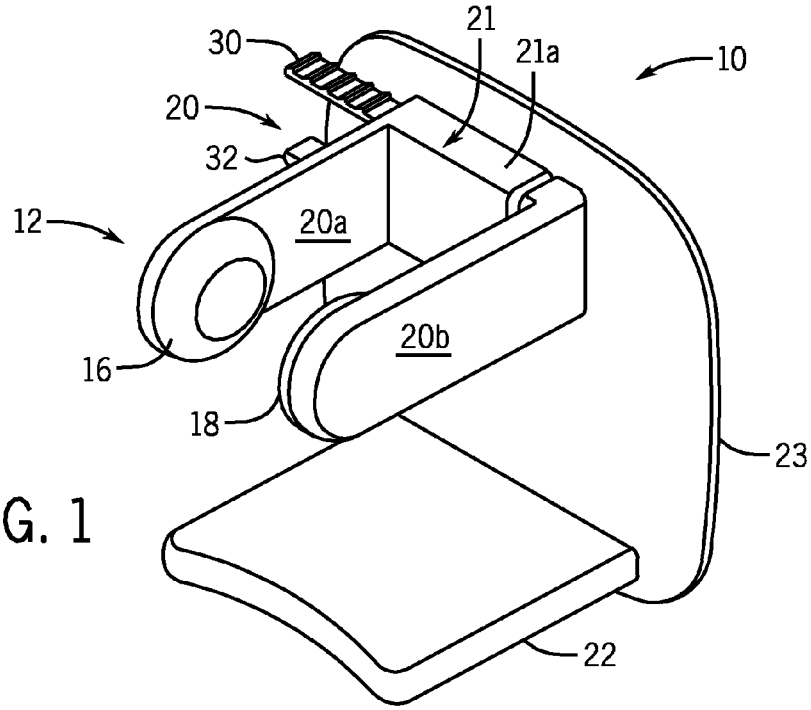
FIG. 1 is a rear, second side and top perspective view of an entertaining nose clasp of the present disclosure.
Figure 9:
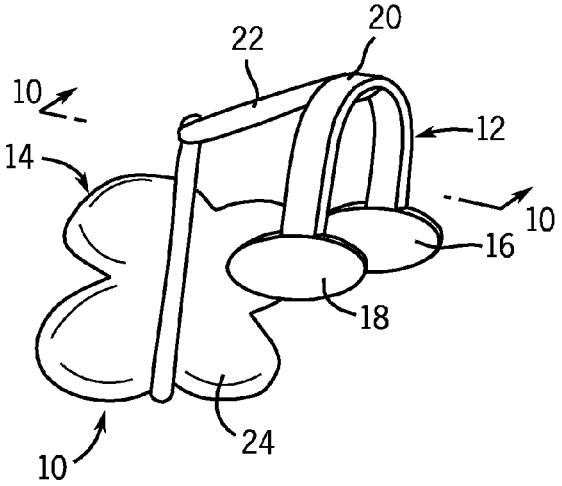
FIG. 9 is side and rear perspective view of an alternative configuration of the entertaining nose clasp apparatus of FIG. 1.

Referring initially to FIG. 1, an entertaining nose clasp apparatus 10 includes a nose clasp 12 and an entertainment device 14 (See FIG. 9). Nose clasp 12 includes a resilient band 20 that has a pair of opposing pads 16 and 18. Band 20 can be a single continuous component or two or more connected components. Pads 16 and 18 are preferably initially positioned at a preferred initial distance of separation that can depend on parameters such as an average nose width and the age of the wearer. As defined herein, nose clasp 12 is a mechanism for the movement and securing of band 20 to the nose of the wearer at a desired comfort level. Apparatus 10 is device that can be easily carried and stored in a diaper-changing bag for an infant.

Figure 2:
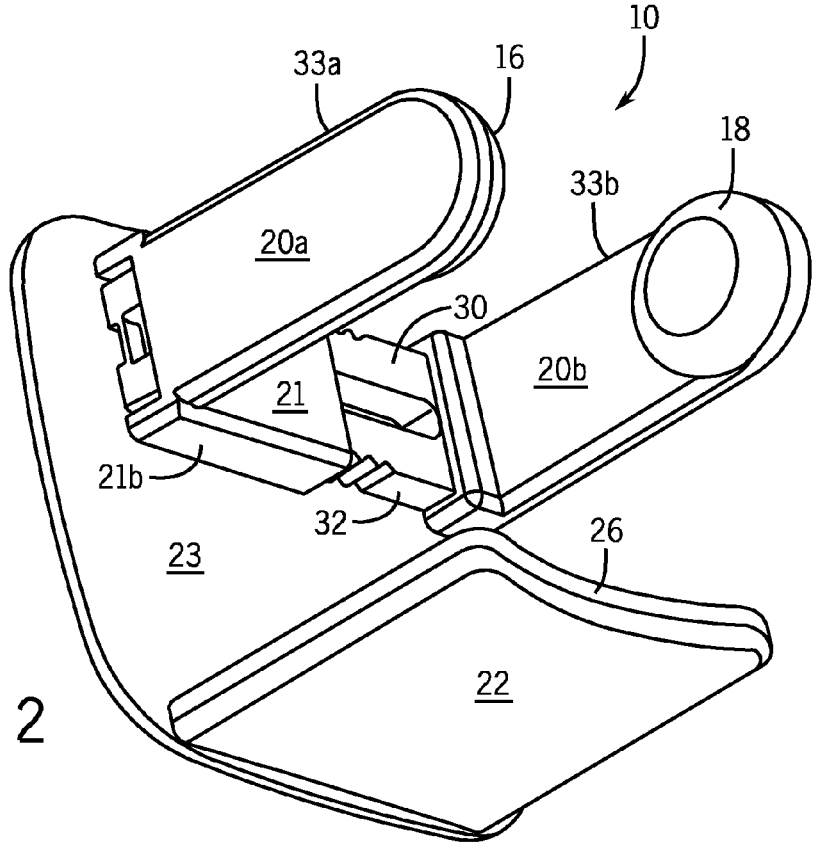
FIG. 2 is a rear, first side and bottom perspective view of the entertaining nose clasp of FIG. 1.

As shown in FIGS. 1 and 2, band 20 nose clasp 12 includes a first component 20*a* and a second component 20*b*. First component 20*a* includes pad 16 and second component 20*b* includes pad 18. First component 20*a* has an approximately right angle shape and is fixedly connected to arms or plate 23 by a housing 21 that extends along plate 23. Component 20*a* connects to housing 21 and extends perpendicular as a cantilever beam to housing 21 and plate 23. First component 20*a* includes an enclosure that defines a lateral or side to side channel in housing 21 that includes a first set of teeth that preferably are directed inwards from a first lateral wall 21*a* and a parallel opposed second lateral wall 21*b*. Second component 20*b* has an approximately right angle shape and is movably connected to housing 21 that extends along plate 23. Second component 20*b* includes a first cantilever beam that preferably includes a pair of approximately parallel beams 30 and 32 that extend at right angles relative to cantilever beam 33*b* of second component 20*b*. Beams 30 and 32 have terminal ends that can be free or connected together depending the desired level of structural rigidity. Beams 30 and 32 have an outwardly directed set of teeth that interface with the set of teeth of first component 20*a* to lock second component 20*b* of band 20 relative to first component 20*a* at a desired position for the clasping of the nose of a wearer.

Nose clasp 12 preferably includes an extension 22 that adds stability to apparatus 10. In this preferred embodiment, extension 22 is connected to plate 23 and adds stability by preventing the rotation of apparatus 10 about pads 16 and 18. In addition, the width of extension 22 adds lateral stability to apparatus 10.

Extension 22 can have a fixed length or have an adjustable length between plate 23 and a terminal free edge 26 that interfaces with the user. Edge 26 preferably has an arcuate shape that approximately conforms to the facial curvature of the region between a wearer's nose and lip. Extension 22 can also be connected to plate 23 such extension 22 is adjustable in both up and down and in the lateral directions.

Plate 23 connects band 20, extension 22 and the entertainment device 14. Plate 23 is shown as a single planar disc, but it is understood that plate 23 can have any shape to include two or more structural members, such as arms, that connect to the entertainment device 14. Plate 23 can also be at least a part of entertainment device 14. In addition, plate 23 can include tabs or grasping devices that facilitate the positioning and removing of apparatus 10 from a wearer's nose. Plate 23 connects to band 20 and extension 22 such that there is a proper interface between apparatus 10 and the user. In the preferred embodiment, plate 23 is substantially concealed by the entertainment device.

Band 20 of nose clasp 12 moves between a first position and a second position to increase or decrease the distance between pads 16 and 18 and thereby accommodate a broad range of noses. Component 20*a* includes cantilevered beam 33*a* that is perpendicular to the plane defined by housing 21 and beams 30 and 32 that connect with housing 21. Pad 16 is positioned in proximity to a free terminal end of beam 33*a*. Component 20*b* includes cantilevered beams 30 and 32 that are perpendicular to a cantilevered beam 33*b*. Pad 18 is positioned in proximity to the free terminal end of beam 33*b*. Pads 16 and 18 are directed inward for directly connecting the nose of a wearer. Beams 30 and 32 are aligned and preferably connected at their free terminal ends by a cross beam. The travel of component 20*b* is limited in an expanding direction away from component 20*a* by a stop in housing 21 that preferably interfaces with the cross beam of between beams 30 and 32. Housing 21 stops the movement of component 20*b* in the opposing direction. The stop also prevents the disassembly of component 20*b* from component 20*a*.

In this embodiment of nose clasp 12, second component 20*b* is independently movable relative to first component 20*a*. The distance between pads 16 and 18 can be increased by pulling and flexing one or both of pads 16 and 18 and/or pulling band 20 apart. This moves and/or flexes band 20 to a second distance of separation between pads 16 and 18. Upon the release of pads 16 and 18, pads 16 and 18 return to their initial unflexed position. The movement of pads 16 and 18 can include the flexing and/or movement of band 20 without the adjustment of beams 30 and 32 with housing 21. For example, fine adjustments of band 20 can include the flexing of cantilevered beams 33*a* and 33*b* for the movement of pads 16 and 18 with the sets of teeth of components 20*a* and 20*b* fully engaged at a single position. Larger movements between components 20*a* and 20*b* can include the additional flexing of beams 33*a* and 33*b* and/or by the disengagement and engagement of the sets of teeth to reposition pads 16 and 18 at a desired distance of separation.

The movement of component 20*a* relative to component 20*b* includes the flexing and disengaging of cantilever beams 30 and 32 relative to the teeth of housing 21. In this preferred embodiment, the outwardly directed teeth on beams 30 and 32 engage the inwardly directed teeth on housing 21. A preset amount of force is applied to component 20*b* relative to component 20*a* to initiate the flexing of beams 30 and 32 and movement across the respective sets of teeth.

Figure 3A:
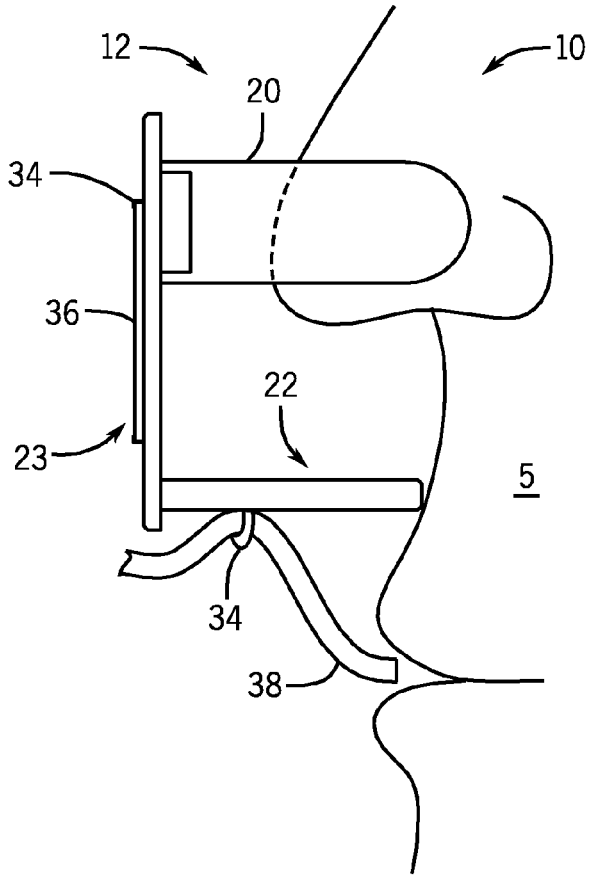
FIG. 3A is a side view of the entertaining nose clasp apparatus of FIG. 1 attached to the nose of a wearer.

Referring now to FIG. 3A, in this preferred embodiment of extension 22, band 20 of apparatus 10 is connected to the nostrils and extension 22 is positioned in an upper lip region that is below the nose and above the lips of the head 5 of a wearer. The position of extension 22 provides an alternative comfortable means of stabilizing apparatus 10 on the nose of the wearer. Band 20 flexes to provide a comfortable level of pressure on the nostrils while securing the position of apparatus 10 on the nose in cooperation with extension 22. As defined herein the terms vertical, up, upper and down are relative to entertaining nose clasp apparatus as worn by the wearer. Thus, the up, upper or upwards refers to the rising vertical direction and down to a descending falling vertical direction. Similarly, the term laterally or side refers to the left and/or right directions.

Apparatus 10 can also include a retention mechanism 34 such as a bracket for the retention of electronic circuitry 36. Electronic circuitry 36 can be in the form of a small circuit card or microprocessor assembly. Brackets 34 and circuitry 36 are preferably positioned on the front or outwardly projecting side of plate 23 for ease of connection to the entertainment device. Alternatively, the electronic circuitry can be embedded into the entertainment device. Electronic circuitry 36, when present, provides additional features to the entertainment device such as light, sound and movement. In one preferred embodiment, a tube 38 is retained by a separate retention mechanism 34 that can be employed by the user to blow into and inflate and/or provide a driving force for a portion of the entertainment device. Plate 23 can also include a retention mechanism 34 that interfaces with the entertainment device to simplify installation, the concealment of plate 23 and/or the removal and replacement of different entertainment devices. In this regard, plate 23 can also be creatively included as a feature of the entertainment device.

Figure 3B:
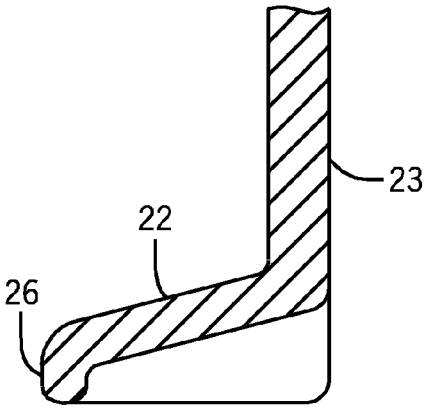
FIG. 3B is the second side view of a plate of the entertainment nose clasp apparatus of FIG. 1 that includes an angled extension with a rounded edge for interfacing with a wearer.
Figure 3C:
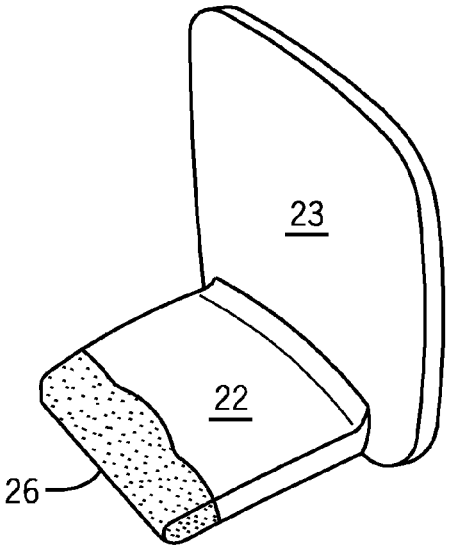
FIG. 3C is a second side and rear perspective view of the plate and extension of FIG. 1 that includes a softer edge for interfacing with the upper lip of the wearer.

Referring now to FIGS. 3B and 3C, the comfort of the human-machine interface between extension 22 and the region above the lips and below the nose can be enhanced by the shape of extension 22 and various molding techniques. Comfort enhancements include increasing the surface area of the terminal edge 26 of extension 22 that contacts the user with a bull nose or other configurations. Similarly, the terminal edge can also include layers or portions of an elastomer or other relatively soft materials that provide a flexible interface.

Figure 5:
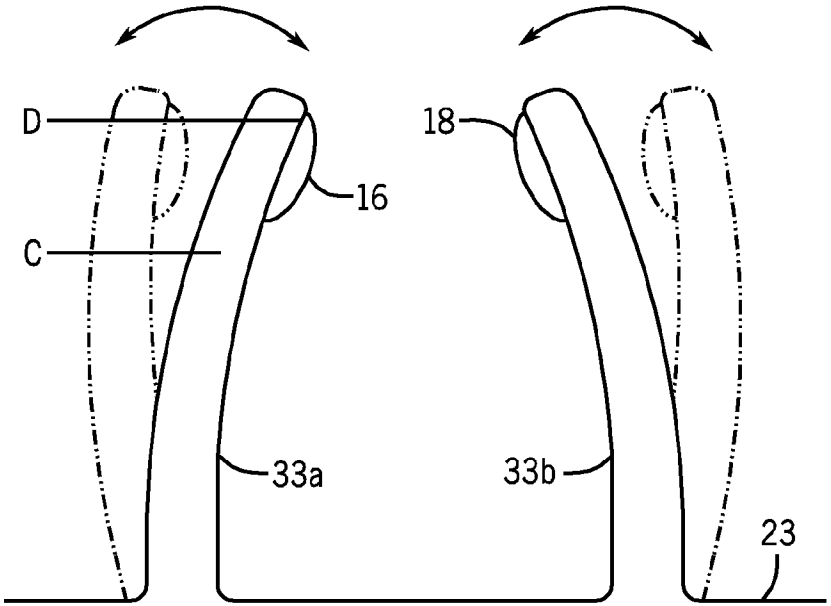
FIG. 5 is a bottom close-up view of two flexing components of the nose clasp of the entertaining nose clasp apparatus of FIG. 1.
Figure 4:
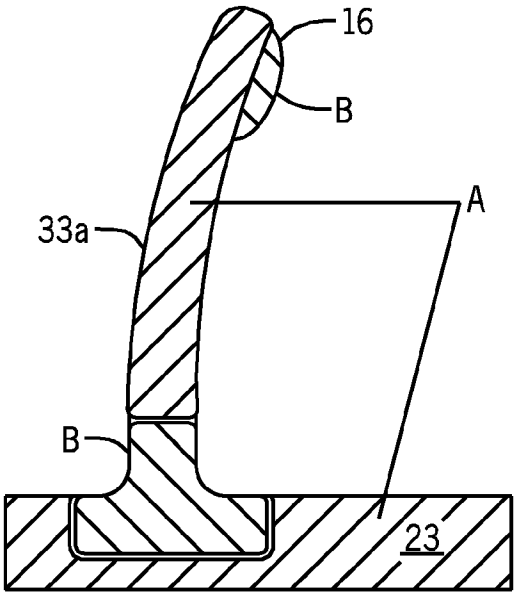
FIG. 4 is a bottom close-up partial view of a component of the nose clasp as an alternative adjustment mechanism of the entertaining nose clasp apparatus of FIG. 1.

As shown in FIGS. 1, 4 and 5, the construction of band 20 cantilever beams 33*a* and 33*b* can vary the amount of flexibility of components 20*a* and 20*b* as at least part of the adjustment mechanism of nose clasp 12. In one preferred embodiment of band 20, portion A is a rigid structure and portion B is a flexible and/or compliant structure. Both portions A and B are preferably made of injection molded polymer materials. In this preferred embodiment, the footing of beam 33*a* is a part of portion B that is integrated with plate 23, is preferably an elastomer material and accommodates the flexing and compliance of components 20*a* and 20*b* to the dimensions of a given nose. Similarly, pads 16 and 18 are parts of portion B that are compliant and flex to add comfort. In another embodiment or variation of band 20, components 20*a* and 20*b* are made of a semi-compliant material C that allows for a small amount of elasticity when used with different sized noses. Pads 16 and 18 have non-slip characteristics and are preferably made of a thermoplastic elastomer material D. These material characteristics can be varied to make beams 33*a* and 33*b* of band 20 solely adjustable by their flexing relative to a fixed base such as plate 23.

Figure 6B:
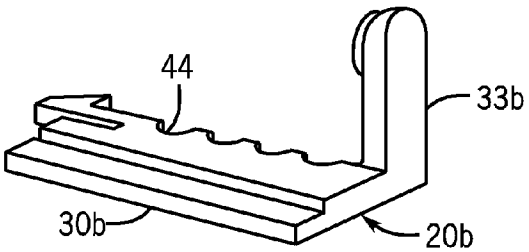
FIG. 6B is a bottom, second side and rear perspective view of one component of the nose clasp of FIG. 6A.
Figure 6D:
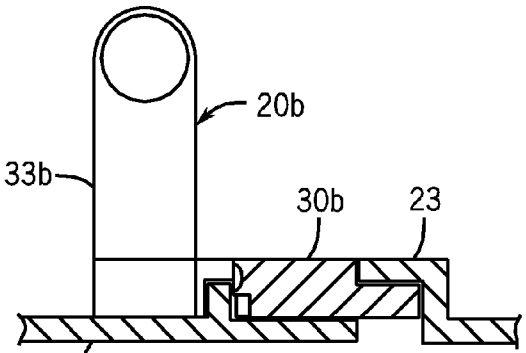
FIG. 6D is a cross-sectional side view taken along lines 6D-6D of the nose clasp of FIG. 6A that further includes a plate.
Figure 6A:
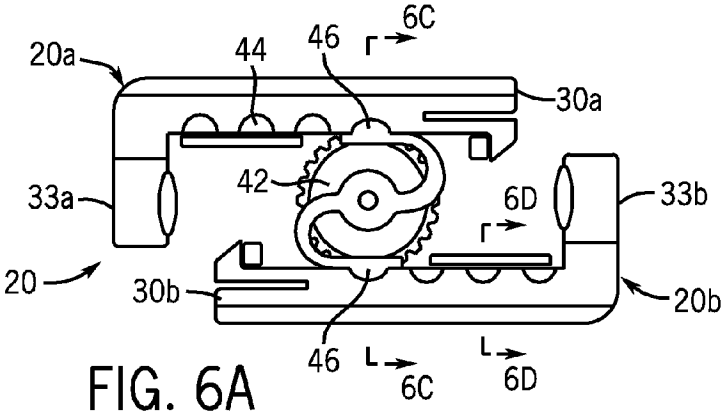
FIG. 6A is an idealized rear view of an alternative adjustment mechanism of the nose clasp of the entertaining nose clasp apparatus of FIG. 1.
Figure 6C:
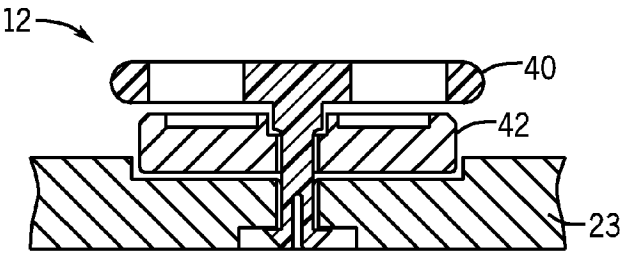
FIG. 6C is a cross-sectional side view taken along lines 6C-6C of the nose clasp of FIG. 6A.

Referring now to FIGS. 6A-6C, another preferred embodiment of nose clasp 12 is shown in which each component 20*a* and 20*b* of band 20 moves in a coordinated and simultaneous manner relative to each other. Components 20*a* and 20*b* are symmetrical and include perpendicular cantilevered beams 30*a*, 33*a* and 30*b*, 33*b*. A bias member 40 connects to plate 23 and is preferably an S-shaped leaf spring. A gear 42 interfaces and coordinates the simultaneous movement of components 20*a* and 20*b*. Bias member 40 includes a post that passes through and provides for the rotational movement of gear 42. The post connects bias member 40 and gear 42 to plate 23.

As shown in FIGS. 6A-6D, components 20*a* and 20*b* define notches 44 in beams 30*a* and 30*b* that interface with a pair of opposing protuberances 46 on bias member 40. The movement of component 20*a*, for example as shown in FIG. 6C, drives protuberances 46 from notches 44 simultaneously moving both components 20*a* and 20*b*. Protuberances 46 are biased to return to the next notch 44 as components 20*a* and 20*b* move simultaneously either inward or outward. This structural configuration of band 20 centrally locates band 20 on plate 23 independent of the position of components 20*a* and 20*b* offers the user the ability to adjust the fit of apparatus 10 with a single hand. Components 20*a* and 20*b* are retained in a central position on plate 23 connected to gear 42 and bias member 40 by a series of interlocking walls on plate 23 that allow for a sliding relation between beams 30*a*, 30*b* of components 20*a*, 20*b*, respectively and plate 23. The central location of band 20 on plate 23 is advantageous because it can aid in the retaining of apparatus 10 on the nose of the user when there are entertainment devices that have various combinations of factors such as weight distributions and asymmetrical configurations.

Figure 7B:
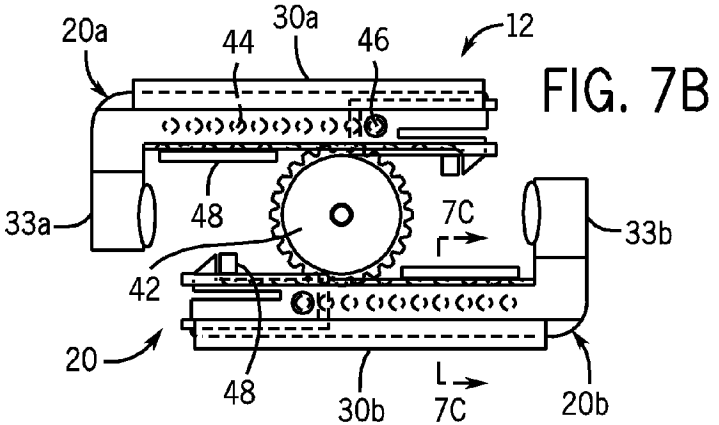
FIG. 7B is an idealized rear view of the second adjustment mechanism of the entertaining nose clasp apparatus of FIG. 1.
Figure 7E:
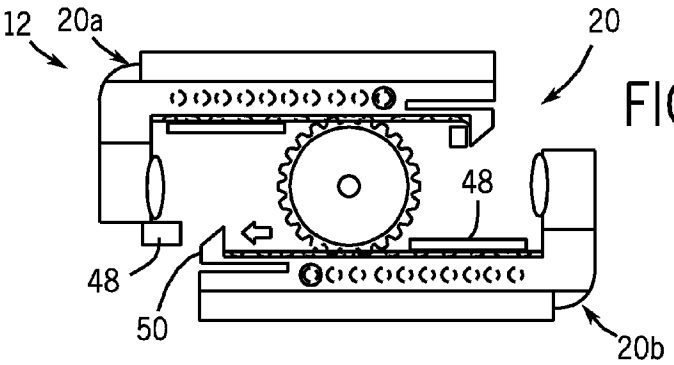
FIG. 7E is an idealized rear view of the nose clasp adjustment mechanism of FIG. 7B showing alternative guide wall positions.
Figure 7A:
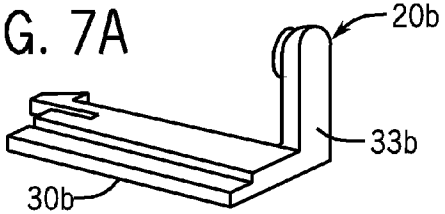
FIG. 7A is a bottom, second side and rear perspective view of one of the components of a second alternative nose clasp adjustment mechanism of FIG. 1.
Figure 7C:
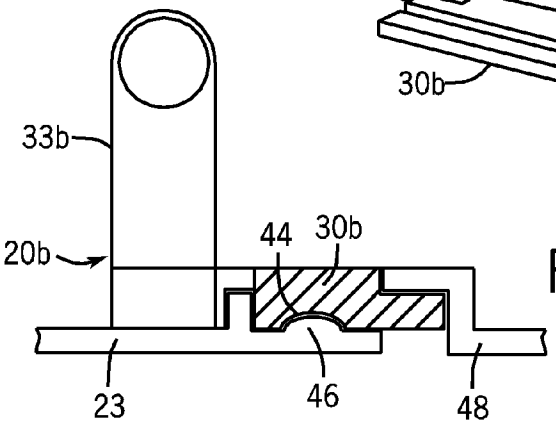
FIG. 7C is a cross-sectional side view taken along line 7C-7C of the component and the plate of the adjustment mechanism of FIG. 7B further including the plate.

As shown in FIGS. 7A-7C an additional preferred embodiment of nose clasp 12 is shown in which each component 20*a* and 20*b* of band 20 moves in a coordinated and simultaneous manner relative to each other using gear 42 to engage components 20*a* and 20*b* to coordinate and direct their simultaneous movement. Component 20*a* includes perpendicular cantilevered beams 30*a* and 33*a* and component 20*b* includes perpendicular cantilever beams 30 and 33*b* as described previously. Components 20*a* and 20*b* include a plurality of notches 44 on the sides of their respective beams 30*a* and 30*b* that interface with plate 23 the at least one protuberance 46. The approximately hemispherical shape of notches 44 and approximately hemispherical shape of protuberance 46 provides for the secure positioning and ease of sliding movement for the selection of the different positional relationships of components 20 and 20*b*. The interface of the multiple notches 44 and protuberance 46 provide for the lateral or side to side adjustment of components 33*a* and 33*b* for comfort of fit and to securely attach apparatus 10 to the user's nose.

Figure 7D:
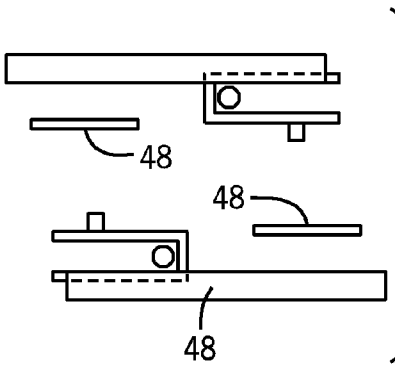
FIG. 7D is an idealized rear view of the plate of the nose clasp of FIG. 7B showing the alignment and position of the guide walls of the plate.

Referring now to FIGS. 7C-7E, another preferred embodiment of nose clasp 12 includes a number of walls 48 extending from plate 23 that guide and/or control the movement of components 20*a* and 20*b*. Beams 30*a* and 30*b* can include cantilevered flexible beams 50 in proximity to their terminal free ends that engage and function to limit the movement in combination with one or more walls or stops 48. This configuration offers a reduced number of components for the previously described advantages of the symmetrical positioning and movement of components 20*a* and 20*b*. The position of the guide walls can be varied to control the range of movement of band 20 components 20*a* and 20*b*. This configuration provides those attributes at a reduced cost and improves reliability.

Figure 7F:
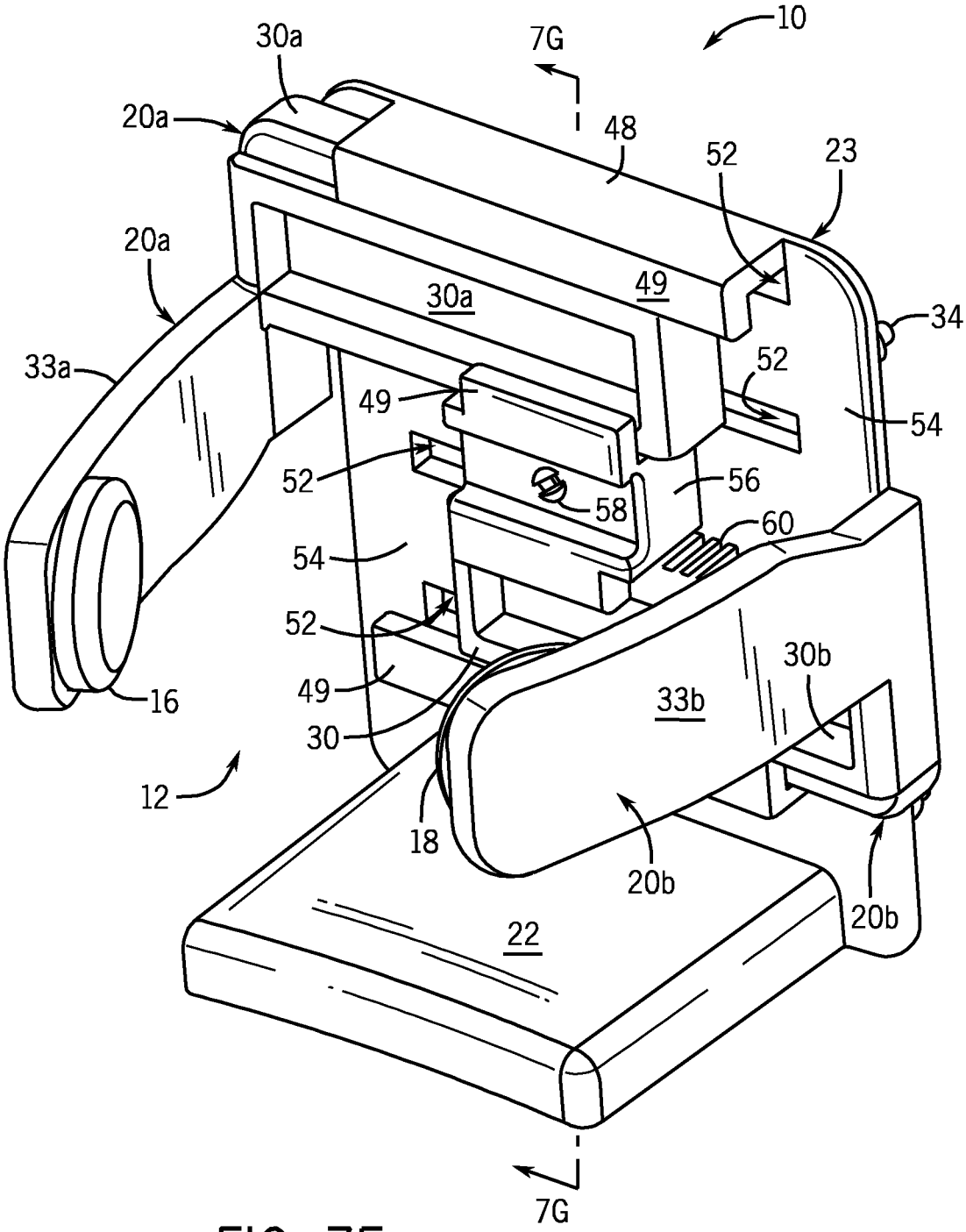
FIG. 7F is a rear, top and side perspective view of a variation of the nose clasp adjustment mechanism of FIG. 7A.
Figure 7G:
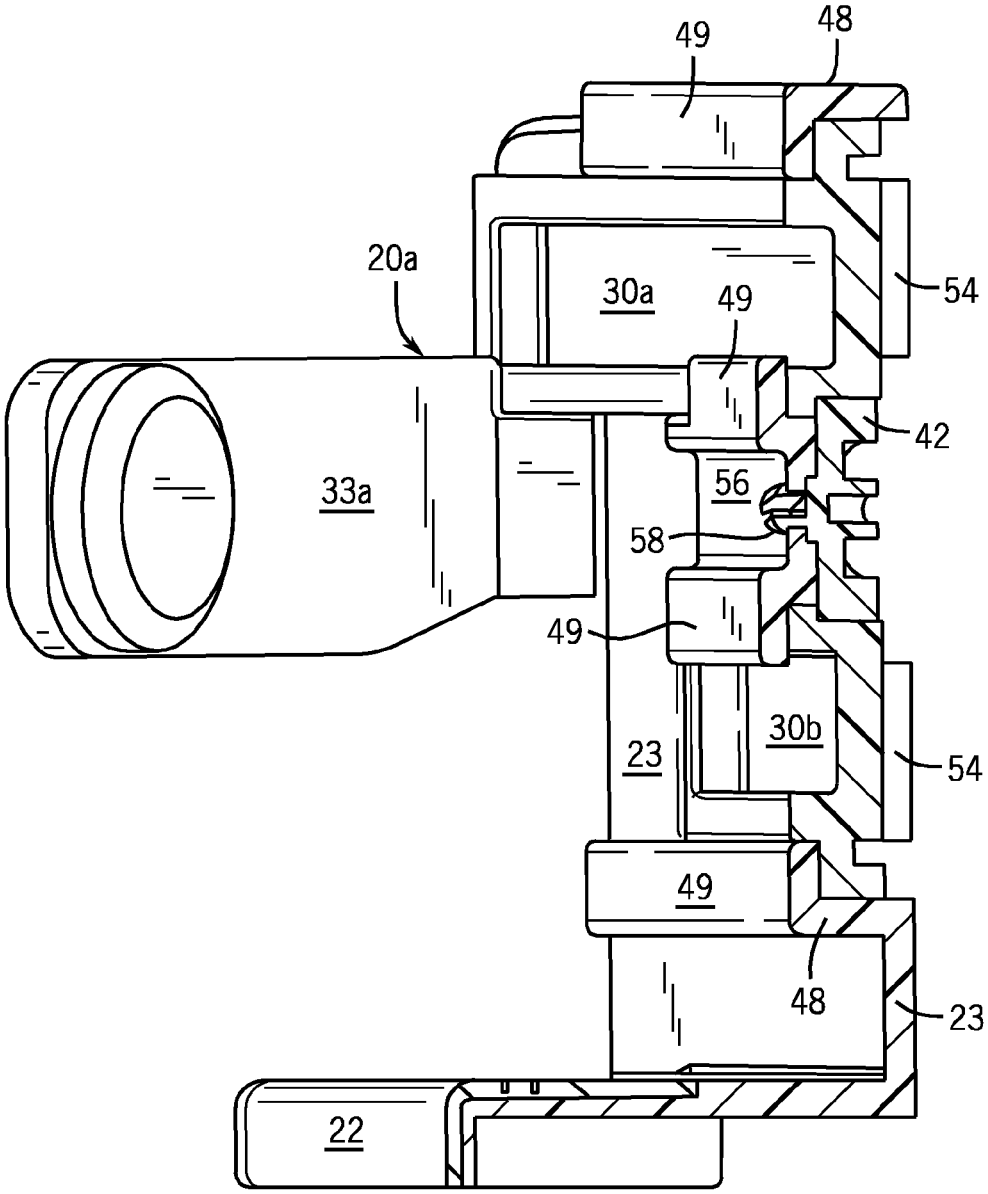
FIG. 7G is a side and rear cross-sectional perspective view of the nose clasp adjustment mechanism of FIG. 7F.
Figure 7H:
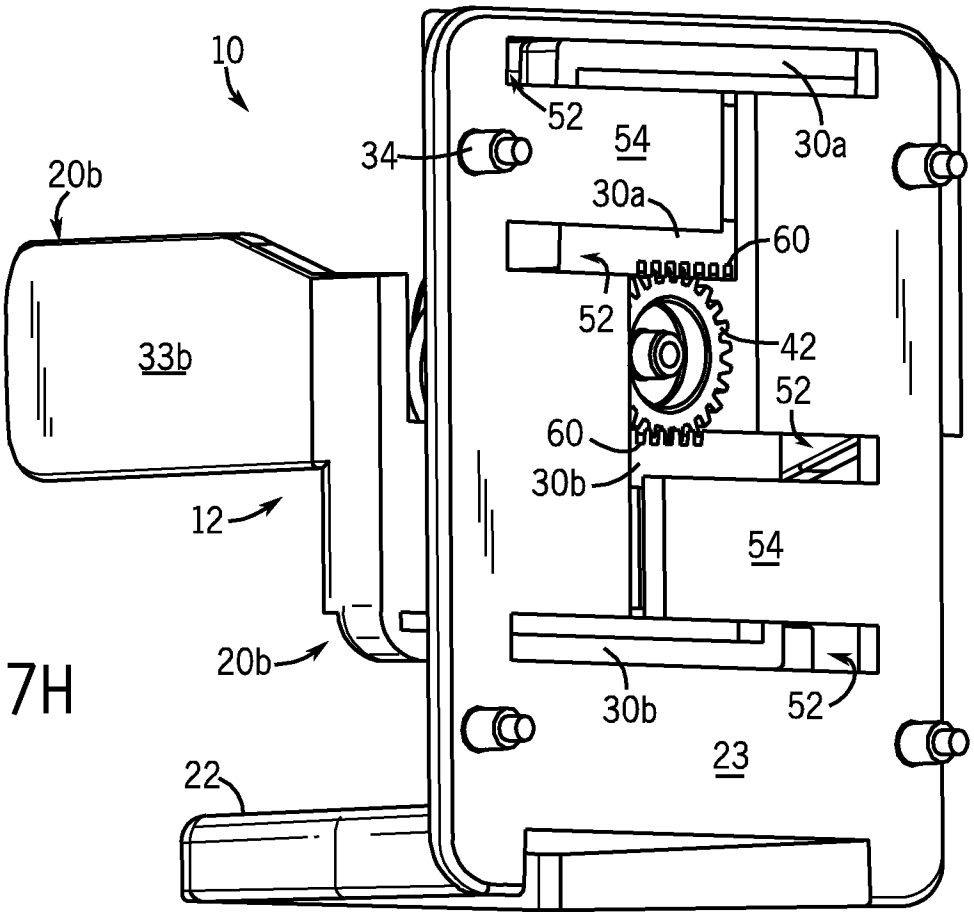
FIG. 7H is a front and side perspective view of the nose clasp adjustment mechanism of FIG. 7F.

Referring now to FIG. 7F-7H, in a further variation of the embodiment of nose clasp, 12 FIGS. 7C-7E, plate 23 defines a series of lateral apertures 52 that define laterally extending cantilevered beams 54. Plate 23 includes guide walls 48 that further include a perpendicular extension that additionally form brackets 49 that retain components 20*a* and 20*b* in position during their coordinated lateral sliding with gear 42. A housing 56 encloses gear 42 and can further include brackets 49.

Cantilevered beams 54 include one or more rearward projecting protuberances 46 that interface with notches 44 on the forward facing sides that interface with plate 23 of beams 30*a* and 30*b* (not shown). Protuberance 46 is preferably an elongate vertically aligned bar and notches 44 are preferably corresponding elongate vertical channels. The cantilevered interface between protuberance 46 and notches 44 provides sufficient integrity for the retention of a selected position for the retention of components 20*a* and 20*a* in an attached position.

In this preferred embodiment, beams 33*a* and 33*b* are offset from a position perpendicular to plate 23 and include an angled or arcuate shape that enhances the ability of beams 33*a* and 33*b* to attach to a nose of a user. Extension 22 can include an at least partially arcuate terminal edge 26 that provides a conforming fit to the face of the user. Retention mechanism 34 is shown that provides an interface for the connecting of electronics for use with entertainment device 14 (See FIG. 9).

Figure 8D:
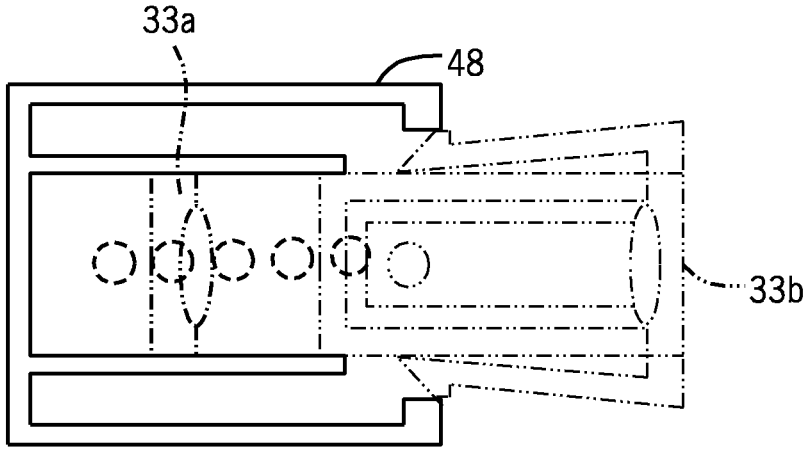
FIGS. 8D-8F are rear views of the third adjustment mechanism of FIG. 8C that show the relative movement between the first component and the second component.
Figure 8E:
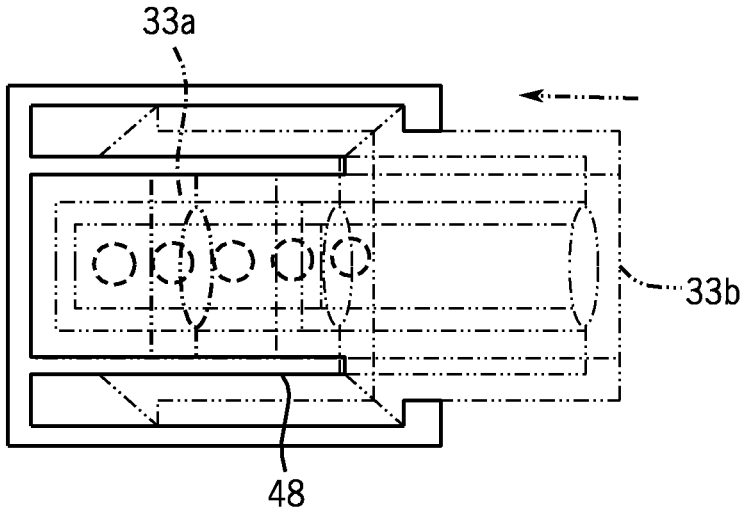
Figure 8F:
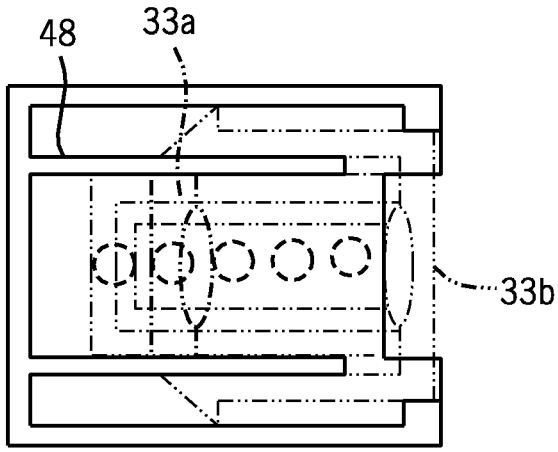

Referring now to FIGS. 8A and 8B in an additional preferred embodiment of band 20, component 20*b* includes a plurality of cantilever beams 30. A first pair of cantilevered beams 30*a* and 30*b* are positioned outside of a second set of inner cantilevered beams 30*c* and 30*d*. First cantilevered beams 30*a* and 30*b* include a stop that can engage walls 48 to limit the travel of component 20*b* and prevent the disassembly of component 20*b* from nose clasp 12. Beam 30*c* is a pair of cantilevered beams connected by a crossbeam. Beam 30*d* is positioned inside the pair of cantilevered beams of beam 30*c* and beam 30*d* has a terminal end that is in proximity to the cross beam of beam 30*c*.

As shown in FIGS. 8B-8F, beam 30*d* includes a protuberance 46 that interfaces with a plurality of notches in component 20*a*. In this embodiment, component 20*a* is fixed in position relative to plate 23 and has a base or housing 21 that defines notches 44. Beam 30 and housing 21 interface in an over—under relation with the underside of housing 21 defining notches 44 and positioned over beam 30 of component 20*b*. Projecting protuberances 46 extend from component 20*b* into the underside of housing 21. Notches 44 and protuberance 46 interface to secure a relative position of band 20 and beam 30*d* flexes to displace protuberance 46 and accommodate the movement between notches 44. This configuration offers simplicity of manufacturing with minimal moving parts.

Referring to FIG. 9, entertaining nose clasp apparatus 10 nose clasp 12 can also include a pair of opposing pads 16 and 18 that are connected together by a continuous resilient band 20. Pads 16 and 18 have a preferred initial distance of separation that can depend on the age of the wearer. The distance between pads 16 and 18 can be increased by pulling one or both of pads 16 and 18 and/or band 20 apart. This flexes band 20 to a second distance of separation between pads 16 and 18. Upon the release of pads 16 and 18 and/or band 20 nose clasp 12 returns to the initial position. Band 20 preferably includes an extension 22 that runs along the ridge of the nose of the wearer that adds stability to apparatus 10 by preventing the rotation of apparatus 10 about pads 16 and 18. Entertainment device 14 can be connected to extension 22 or directly to resilient band 20. Apparatus 10 is intended to be a readily foldable or collapsible device that can be easily added to a diaper changing bag for an infant.

Figure 10:
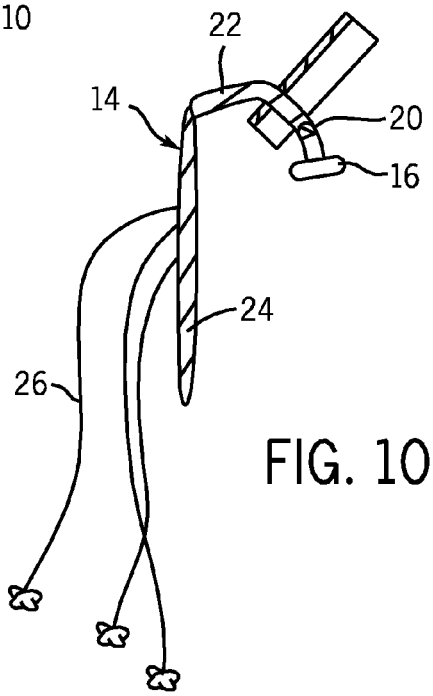
FIG. 10 is a cross-sectional side view of the alternative configuration of the entertaining nose clasp apparatus of FIG. 9.
Figure 11A:
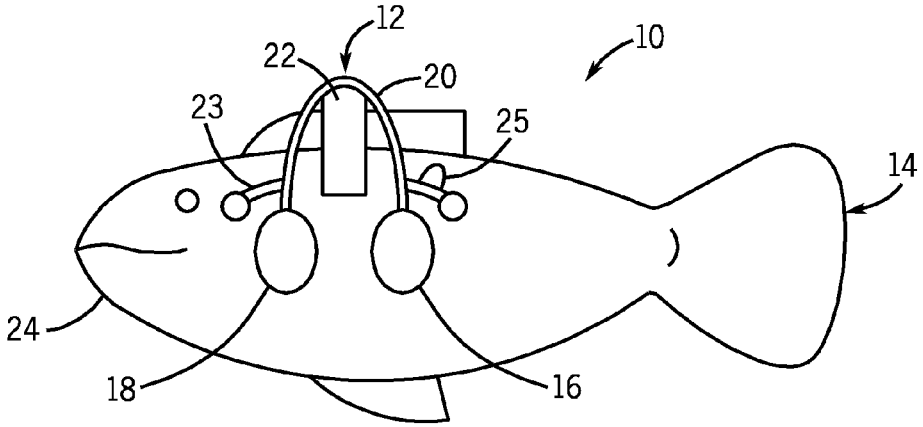
FIG. 11A is a rear view of the alternative configuration of the entertaining nose clasp apparatus of FIG. 9 showing a fish entertainment object.
Figure 11B:
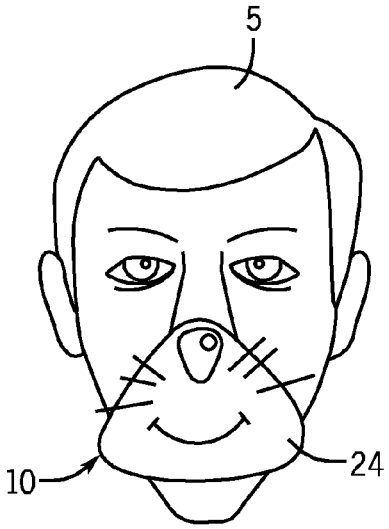
FIG. 11B-11Q are frontal views of entertainment objects of the alternative entertaining nose clasp apparatus of FIG. 1.
Figure 11C:
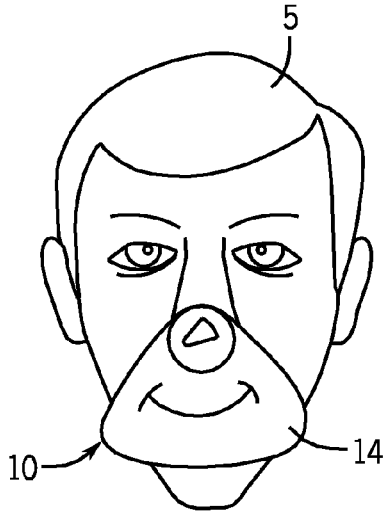
Figure 11D:
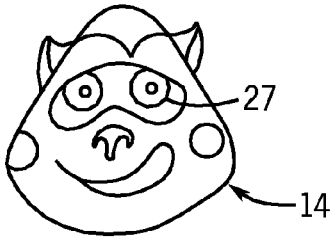
Figure 11E:
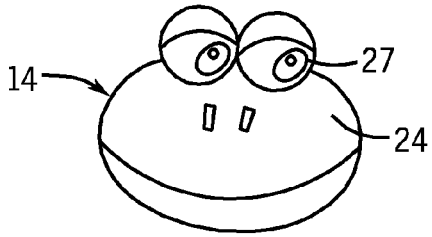
Figure 11F:
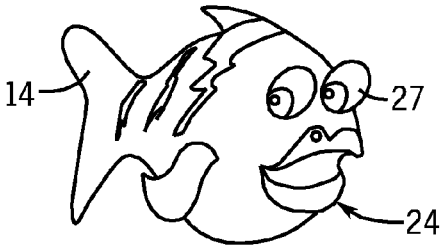

As shown in FIGS. 9, 10 and 11A, extension 22 can further include braces or arms 23 that connect to entertainment device 14 that can aid in the stabilization of apparatus 10. In addition, arms 23 can include tabs 25 or grasping devices that facilitate the positioning and removing of apparatus 10 from a wearer's nose.

Entertainment device 14 includes an object 24 that connects to nose clasp 12 and includes a visually attractive appearance and/or entertaining feature. Object 24 can be permanently connected to clasp 12 as a monolithically formed assembly, using an adhesive or connected by a heat bond, for example. Alternatively, object 24 can be selectively detached from and reattached to clasp 12 using a standard mechanical connection such a groove and slot or snap. Entertainment device 14 as defined herein includes novelty type items for entertainment, but can also include devices, for example, that are directed towards education and stimulate development in infants.

Referring now to FIGS. 3A, 9, 10, 11A, 11B and 11C, object 24 can be a two dimensional pictorial representation of an object such as a butterfly or a three dimensional representation of a flower, for example. The connection between object 24 and clasp 12 is constructed to ensure that the visibility of the head 5 of the wearer is not critically inhibited such that the wearer has the visual clearance to perform routine tasks. In that regard, object 24 is preferably connected in proximity to the nose and extends downward so as not to unduly restrict visibility for the performance of tasks such as routine a diaper changing and to provide direct eye contact with the infant. Alternatively, object 24 can include apertures through which a wearer can see or include at least partially transparent windows that allow the wearer the vision necessary to perform routine tasks.

Object 24, as stated previously, is intended to be an attention-grabbing object to an infant. In that regard, object 24 can have pleasant entertaining features that can include visual, aural and texture enhancements. Additional visual enhancements can include colors, sounds, lights, scents, reflective materials and/or, for example, a two dimensional display that simulates a three dimensional image or holograph. Object 24 can be a relatively small visual display such as flat panel display that is appropriately sized and supported that is programmed to provide the desired visual display and aural accompaniment. The additional weight for larger sizes of displays can be offset, as required, by the use of a strap and/or a connection to a counterweight that balances the weight of the display. The counterweight if required, could include, for example, the support electronics.

Visual enhancements include as described previously two-dimensional or three-dimensional objects that can further have hanging elements 26 that are constructed to entice the infant or child to reach for them and thereby keep their hands and arms in a desirable location that is away from the dirty diaper. The hanging elements can include, for example, a mobile, soft resilient elements or elements that can be pulled from a stored energy device such as biased reel that are drawn back into the reel or storage unit upon release. The hanging elements are constructed with a sufficient amount of minimal force such that the child can grab and extend the element without pulling the element off the wearer.

Figure 11G:
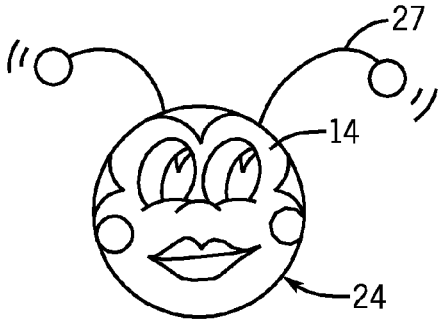
Figure 11H:
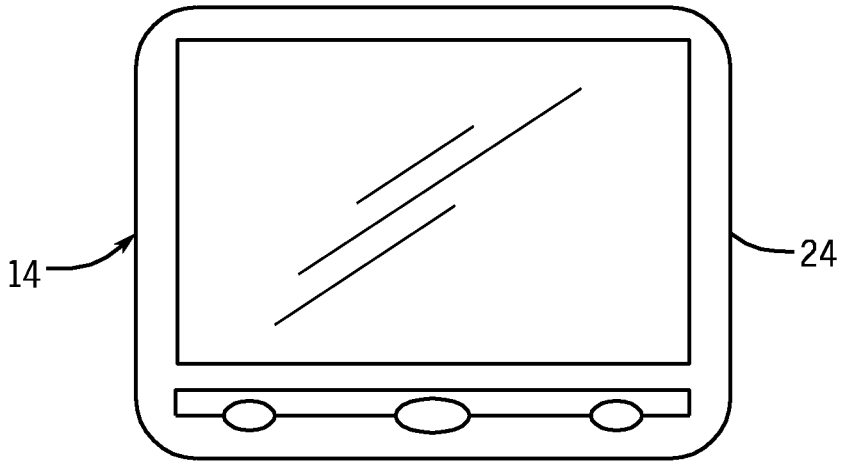
Figure 11I:
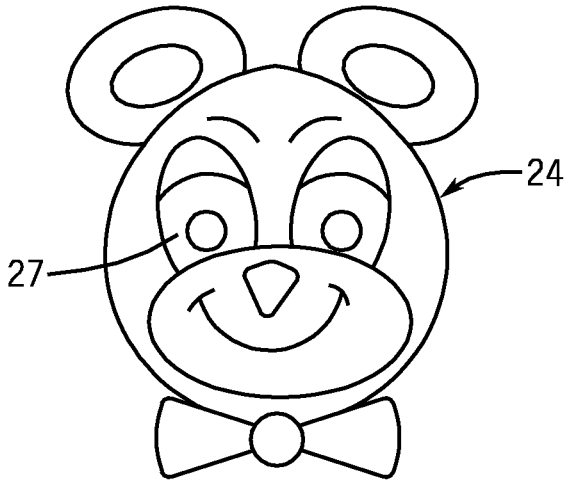
Figure 11J:
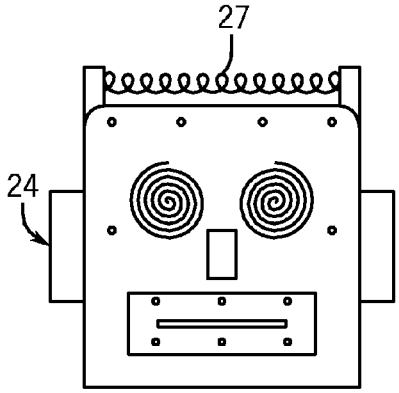
Figure 11K:
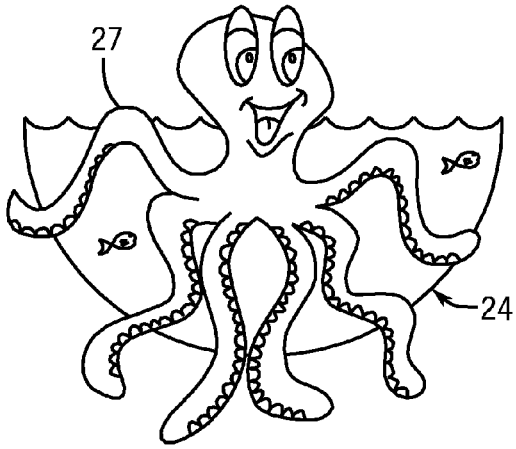
Figure 11L:
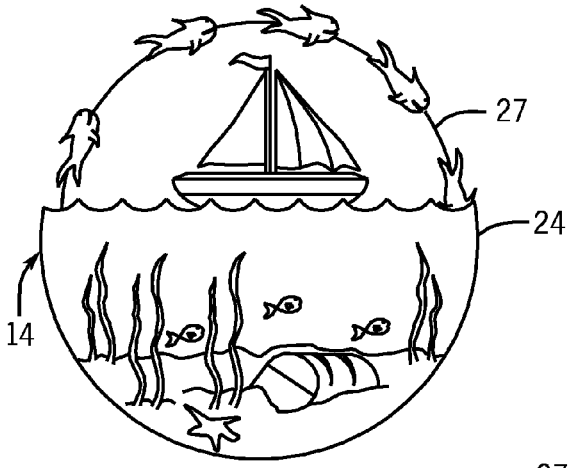
Figure 11M:
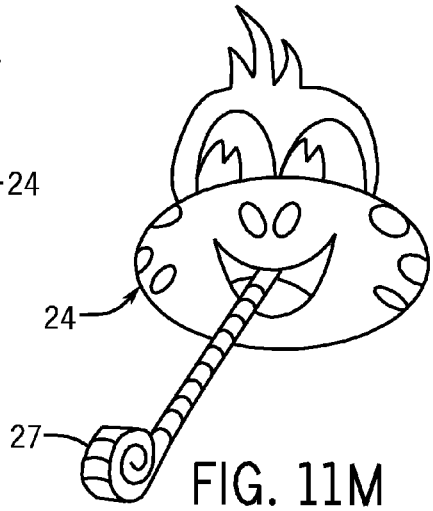
Figure 11N:
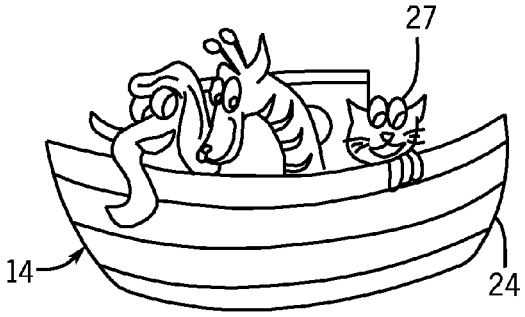
Figure 11O:
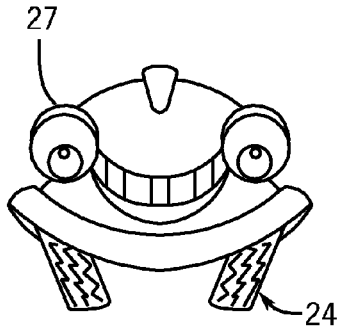
Figure 11P:
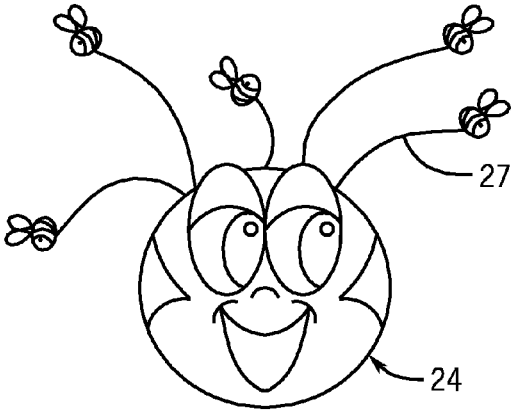
Figure 11Q:
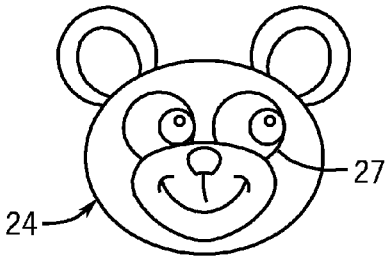

As shown in FIGS. 3A, 9, 10 and 11A-Q, visual displays can also include mobiles or similar hanging, moving or movable devices that can be moved by the infant or alternatively by a source of energy and gears connected to apparatus 10. In one preferred embodiment, movement of one or more entertainment components 27 of object 24 are driven by the breath of the wearer. The wearer can selectively place a tube in their mouth and by blowing into the tube, forcing air to drive and move component 27. The tube can further include a manifold or tubular distribution network to drive multiple components 27. In this preferred embodiment, the movements of component(s) 27 can include eyes and/or eye lids that move such as those of FIGS. 11D-11G, 11J (rotate), 11O and 11Q; movable antennae as in FIGS. 11G and 11P, FIG. 11K the arms of the octopus and/or the octopus relative to the simulated water; FIG. 11L the rotating circle of fish; FIG. 11M the straw that projects or elephant's trunk that extends outwardly by forced air and then retracts when the air pressure is dropped; FIG. 11N the animals in Noah's ark; wings that flap; rotational movement such as that of a wheel or blades; and cars that move along a racetrack.

Additional visual displays of object 24 include lights 28 that can be actuated by the wearer or preset to a desired pattern. For example, in FIG. 11I a LCD light is used for the eyes of a teddy bear. Apparatus 10 in this embodiment includes a source of energy such as a battery and electrical connections to the lights. A switch can also be included as an on/off selecting switch or alternatively vary the lights between different options.

Visual displays can also include soft flexible and thin containers of water that add to the visual attractiveness of object 24. Variations can include the water in FIGS. 11K and 11L, for example. The water can be in a sealed polymer container and further include for example "snow" that can be stirred up to create a winter type display such as those commonly employed in paperweights. Alternatively, the container can include a coupling to the air tube of the wearer, a one way valve and a pressure release valve such that the wearer can blow into the water and create bubbles and the air pressure can vent from the container.

Object 24 can also include aural displays that can include one or more recorded sounds such as music, natural sounds such as those from the surf, animal sounds and/or voices. In this preferred embodiment, apparatus 10 would also include a source of energy and would preferably include a switch as described that could alternate between on and off and select alternative sounds. The aural capability could also include the ability for the wearer to record their own voice to recreate a familiar voice or an interface to transfer a digitally recorded song of their own choosing, for example. In another preferred embodiment, the source of the sound can also be breath or air powered such as the buzzing of the bee in FIG. 11P, but can also include musical instruments such as a harmonica or small recorder.

Object 24 can also be directly interactive with the infant as described above with differing tactile sensations such as such as those for cotton cloth as well as other materials such as ribbon, for example. Object 24 can further include aids for teething for infants.

Entertaining nose clasp apparatus 10 can be made of any material that is safe for use with infants and small children. Nose clasp 12 is preferably a specialized nose clasping device that makes a firm connection to the nose, can optionally block the air flow through the nasal passages and has a firm connection to the nose. The firm connection of nose clasp 12 includes the need to retain entertaining nose clasp apparatus in position on the wearer's nose when the wearer bends over during typical operational use such as, for example, the changing of a diaper. In this regard, it is advantageous for nose clasp 12 to be constructed with nose pads 16 and 19 and extension 22 being appropriately sized beyond the normal function of standard nose clips to simply close the nostril opening and to provide a secure connection to the wearer's nose when the additional weight of an entertainment device 14 is included. Nose clasp 12 can be an existing nose clip such as those commonly employed by swimmers that is modified or alternatively with the addition of extension and a connector to entertainment device 14. Entertaining nose clasp apparatus 10 can be made of polymer, metal, cellulose or composite materials that can include silicones and related materials. As discussed previously, these materials can be molded together and/or integrated to provide specialized beneficial attributes for the mechanism of nose clasp 12 that provides for the adjustment, attachment and securing of components 20*a* and 20*b* of band 20 on the nose of the wearer.

Entertainment device 14 can be fabricated either of similar materials as clasp 12 or of alternative materials. Alternative materials include textiles such as cotton as well as man made materials. It can be particularly advantageous for at least device 14 to be washable and or sanitized using readily available household cleansers/cleansing means. In one preferred embodiment, device 14 is a soft textile based object 24 that can be separated from clasp 12 and cleaned in a washing machine.

In operation as shown in FIGS. 1-11Q, entertaining nose clasp apparatus 10 is positioned on the nose of the wearer securing the nostrils of the wearer closed. The switch for any aural, motion or light devices or the connection of a blowing tube to the mouth of the wearer is accessible before and after positioning apparatus 10 on the nose of the wearer. Extension 22 in combination with pads 16 and 18 provide a secure attachment to the wearer's nose even when the wearer bends or leans over, for example. The wearer proceeds to change the infant's diaper without the unpleasant odors and the infant is drawn to and distracted by entertainment device 14 during the diaper changing process. Upon completion of the diaper change, the wearer removes and sanitizes apparatus 10 as appropriate.

In the preceding specification, the present disclosure has been described with reference to specific exemplary embodiments thereof. It will be evident, however, that various modifications, combinations and changes may be made thereto without departing from the broader spirit and scope of the invention as set forth in the claims that follow. For example, any one of the embodiments of the differing nose clasps 12 can be defined as nose attachment mechanisms that provide the means to attach apparatus 10 to the nose of a wearer. Thus, the embodiments described herein can be applied or combined as novel features between the embodiments described herein. The specification and drawings are accordingly to be regarded in an illustrative manner rather than a restrictive sense.

What is claimed is:

1. An entertaining nose clasp apparatus that comprises;

a nose clasp that includes a band, the band adapted to connect to the outside of a nose;

an extension that has a first side, a second opposed side and side edges, the extension connects to the nose clasp and the structure of the extension adapted for positioning on the face of the wearer adjoining the nose of the wearer; and an entertaining device connected to the extension, the extension stabilizing the position of the entertaining device relative to the nose of the wearer.

2. The entertaining nose clasp of claim 1, wherein the extension is adapted to be positioned along the ridge of the nose.

3. The entertaining nose clasp of claim 1 that further includes a plate, the plate includes a first side, an opposed second side and side edges.

4. The entertaining nose clasp of claim 3, wherein the extension connects to the plate on one end and has an opposing free edge.

5. The entertaining nose clasp of claim 1, wherein the nose clasp includes an adjustment mechanism and the band includes at least two components, the adjustment mechanism moves at least one of the at least two components.

6. The entertaining nose clasp of claim 1, wherein the extension is adjustably moveable.

7. The entertaining nose clasp of claim 1, wherein the extension is positionable between upper lip and nose of the wearer.

* * * * *